US005929738A

United States Patent [19]

Orlando

[11] Patent Number: 5,929,738

[45] Date of Patent: Jul. 27, 1999

[54] TRIPLE CORE TOROIDAL TRANSFORMER

[75] Inventor: Vito Orlando, Seattle, Wash.

[73] Assignee: Thomas & Betts International, Inc., Sparks, Nev.

[21] Appl. No.: 09/097,241

[22] Filed: Jun. 12, 1998

Related U.S. Application Data

[60] Provisional application No. 60/049,764, Jun. 16, 1997.

[51] Int. Cl.[6] ..... H01F 27/28; H01F 30/12

[52] U.S. Cl. ..... 336/180; 336/229; 336/12

[58] Field of Search ..... 336/229, 180, 336/212, 226; 333/119, 131, 25, 32, 12

[56] References Cited

U.S. PATENT DOCUMENTS

| | | | |
|---|---|---|---|
| 3,657,728 | 4/1972 | Mitsui et al. | 307/20 |
| 3,705,365 | 12/1972 | Szabo et al. | 333/12 |
| 4,129,820 | 12/1978 | Brock | 336/12 |
| 4,194,231 | 3/1980 | Klein | 361/45 |
| 4,225,899 | 9/1980 | Sotiriou | 361/188 |
| 4,245,286 | 1/1981 | Paulkovich et al. | 363/21 |
| 4,266,190 | 5/1981 | Lipman | 324/117 R |
| 4,318,166 | 3/1982 | Bloom | 363/26 |
| 4,342,013 | 7/1982 | Kallman | 333/181 |
| 4,347,469 | 8/1982 | Dinger | 318/533 |
| 4,348,613 | 9/1982 | Hormel et al. | 315/130 |
| 4,360,784 | 11/1982 | Bartlett | 330/9 |
| 4,490,844 | 12/1984 | Sohn | 381/104 |
| 4,556,927 | 12/1985 | Steger | 361/215 |
| 4,621,298 | 11/1986 | McMillen | 361/38 |
| 4,907,246 | 3/1990 | Kleiner | 323/335 |
| 4,947,308 | 8/1990 | Gulczynski | 363/16 |
| 5,051,609 | 9/1991 | Smith | 307/270 |
| 5,077,543 | 12/1991 | Carlile | 333/177 |
| 5,109,206 | 4/1992 | Carlile | 333/177 |
| 5,182,537 | 1/1993 | Thuis | 336/180 |
| 5,220,204 | 6/1993 | Burkhead | 307/268 |
| 5,220,304 | 6/1993 | Ho | 336/192 |
| 5,331,271 | 7/1994 | Thuis | 323/355 |
| 5,461,351 | 10/1995 | Shusterman | 333/181 |
| 5,534,768 | 7/1996 | Chavannes et al. | 323/267 |

*Primary Examiner*—Michael L. Gellner
*Assistant Examiner*—Anh Mai
*Attorney, Agent, or Firm*—Weingarten, Schurgin, Gagnebin & Hayes LLP

[57] ABSTRACT

A triple core transformer including a coupler connected to a third core between two primary windings. Two sets of twisted pairs are wound around each primary core such that a strand of each pair communicates with primary each core. One strand of each pair is wound denser than the complementary strand of that pair. The denser strands are connected to a third winding around the third core. The third winding is wound in a series of segments. Each of the segments is connected to the preceding segment in a wire twist.

10 Claims, 4 Drawing Sheets

| PIN NUMBER | WIRE COLOR |
|---|---|
| P1 | RED/GREEN |
| P2 | GREEN |
| P3 | RED/GREEN |
| P4 | GREEN |
| P5 | GREEN |
| P6 | RED/GOLD |
| NU (NOT USED) | GREEN/GOLD |

| PIN NUMBER | WIRE COLOR |
|---|---|
| P1 | RED/GREEN |
| P2 | GREEN |
| P3 | RED/GREEN |
| P4 | GREEN |
| P5 | GREEN |
| P6 | RED/GOLD |
| NU (NOT USED) | GREEN/GOLD |

SCHEMATIC

| PIN NUMBER | WIRE COLOR |
|---|---|
| P1 | RED/GREEN |
| P2 | GREEN |
| P3 | RED/GREEN |
| P4 | GREEN |
| P5 | GREEN |
| P6 | RED/GOLD |
| NU (NOT USED) | GREEN/GOLD |

TRIPLE CORE TOROIDAL TRANSFORMER

CROSS REFERENCE TO RELATED APPLICATIONS

This application claims priority to U.S. provisional patent application No. 60/049,764, filed Jun. 16, 1997, entitled TRIPLE CORE TOROIDAL TRANSFORMER, incorporated herein by reference.

STATEMENT REGARDING FEDERALLY SPONSORED RESEARCH OR DEVELOPMENT

N/A

BACKGROUND OF THE INVENTION

Transformers are used in a variety of electrical circuits to transfer electrical energy from one part of a circuit to another through magnetic field coupling. A transformer is typically constructed from two or more coils, or windings, of wire in close proximity such that electrical characteristics may be transferred. Typical characteristics transferred through a transformer include voltage magnitude, current magnitude, phase, and impedance level.

In radio frequency (RF) transformers, complex electrical signals of varying frequencies are often transferred. Typically these types of transformers operate at much higher frequencies than transformers used for power transfer, and are also designed to operate at a wide frequency range, often several decades wide. Such transformers must therefore minimize power loss, or leakage flux, by insuring that substantially all flux passing through one coil also passes through the others.

One type of RF transformer is known as a coupler, or power divider. Such a transformer is used to provide low frequency impedance matching between the input circuit and the output circuit. This type of transformer is often used with electrical transmission signals for accurate frequency response. Such accuracy is necessary for reliable transmission of data over an electronic medium.

In the telecommunications industry, such complex electrical transmission signals often comprise large amounts of information in varying forms, such as voice and data. These signals carry the data from a number of sources to a number of remote destinations. Various frequencies manipulations are used to organize the data so carried to insure complete, reliable transfer to a destination. The quantity of such frequency manipulations which can be supported is called bandwidth. Increased efficiency of bandwidth use is required due to rising demand for modern developments such as quality-of-service (QOS) and real-time applications. It is therefore desirable to maximize the bandwidth available over a particular line through such frequency manipulations.

Such bandwidth usage, however, is prone to physical constraints. Such constraints include interference from external sources, distance and power loss restrictions due to electrical resistance, and signal degradation due to switching points across the physical network.

It would be beneficial to develop a coupler with enhanced frequency response and reflection to minimize flux loss and provide superior impedance matching. Such a coupler has broad application in contexts where electrical transmission signals suffer from such physical bandwidth constraints.

BRIEF SUMMARY OF THE INVENTION

A triple core toroidal transformer includes a dual core transformer, or coupler, connected to a third autotransformer core between the two primary windings. A series of terminals provide input and output for the transformer. Each terminal may support a single conductor strand, or a twisted wire pair conductor strand. Two sets of twisted wire pairs are wound around each primary core such that a strand of each twisted pair communicates with each primary core. One strand of each pair is wound substantially denser than the complementary strand of that pair. The substantially denser wound strands are electrically connected to a third winding around the autotransformer core. The third winding is wound in a series of segments around the autotransformer coil. Each of said segments is connected to the preceding segment in a wire twist manner, and may also be connected to a terminal.

DETAILED DESCRIPTION OF THE INVENTION

The triple core toroidal transformer as disclosed by the present application comprises three hollow cylindrical ferrite cores, each wound with and interconnected by wire strands or twisted pair conductors as described herein. The interconnection of the two coupler cores and windings to the third autotransformer core is shown with a mapping to a set of terminals as identified herein. Each of said terminals could comprise either an input or an output, depending upon the application and the desired frequency response.

As is typical with the industry, a winding is a wrapping of the wire strands longitudinally through the center bore of the hollow core and longitudinally around the outside of the core. Typically a winding is specified as a number of turns, wherein each complete turn involves one run of the wire through the center bore and one run longitudinally around the outside. A half turn involves a run only through the center bore.

Figure 1:
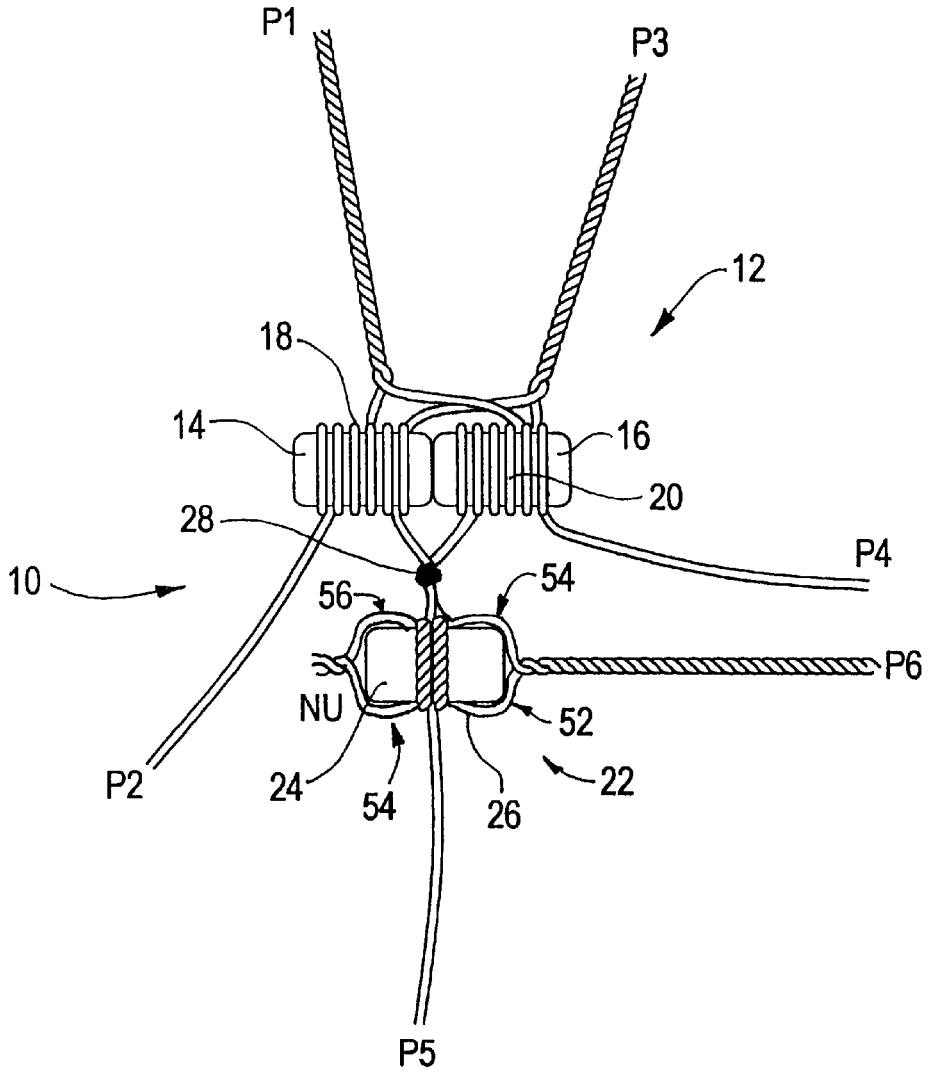
FIG. 1 is a side view of the triple core toroidal transformer as disclosed herein.

Referring to FIG. 1, a side view of the transformer 10 is shown. A coupler including first and second coupler cores 14, 16 is shown with respective first and second coupler windings, 18, 20 respectively. Each coupler winding 18, 20 further includes a greater winding and a lesser winding, so labeled because the lesser winding has fewer turns around the core. These coupler windings 18, 20 are shown attached to autotransformer 22. Autotransformer 22 includes a autotransformer core 26 and autotransformer winding 25, wherein autotransformer winding 26 is connected to coupler 12 at electrically conductive junction 28.

Figure 2A:
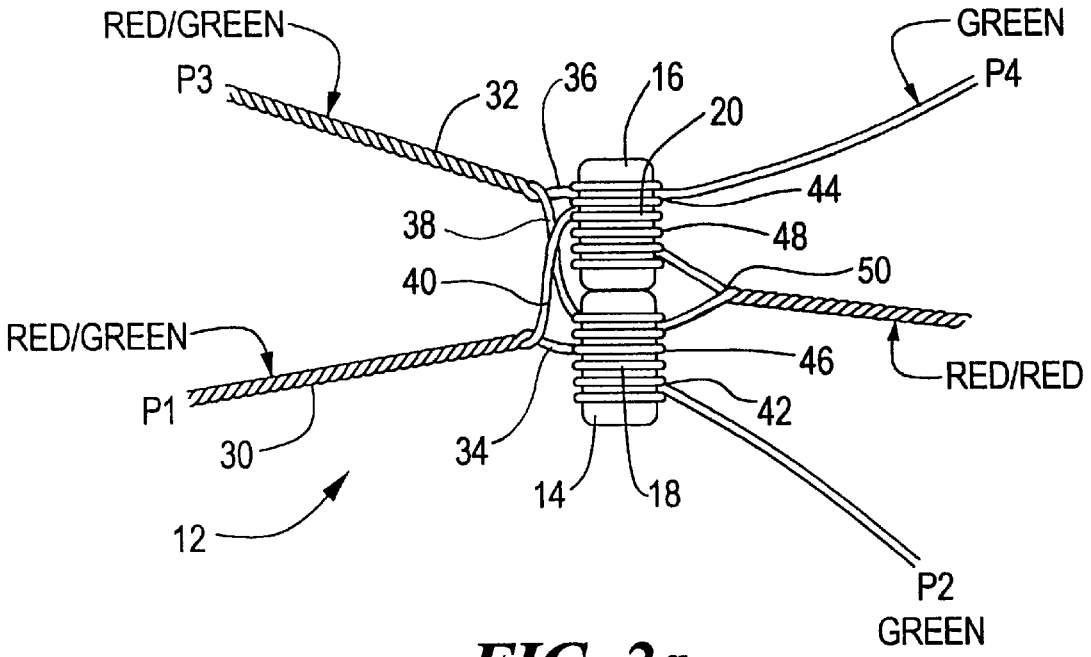
FIG. 2*a* is a side view of a coupler portion of the transformer in FIG. 1.

Referring to FIG. 2*a*, a side view of the coupler is shown. Note that wire color references are to clarify twisted pair and single strand conductors, and should not be taken to supersede reference numbers. As is typical within the industry, a single electrical input or output terminal connection, described above, may refer to either a single strand connection or to a twisted pair connection, as indicated by the pin number identifications.

FIG. 2*a* shows the construction of the coupler 12. First and second twisted pair strands 30, 32 are received by first and second coupler cores 14, 16. Each twisted pair includes a red strand and a green strand twisted together to nullify interfering flux. The green strands 34, 36 comprise the lesser winding 42, 44 respectively, of each coupler winding 18, 20 respectively, and are each wrapped around the first and second coupler cores 14, 16, respectively. The red strands 38, 40 comprise the greater winding 46, 48 respectively, of each coupler winding 18, 20 and are each wrapped around the first and second coupler cores 14, 16 respectively. The number of turns can vary, however in the preferred embodiment the lesser windings 42, 44 are a half turn through the core and the greater winding 46, 48 are six and a half turns.

Figure 4:
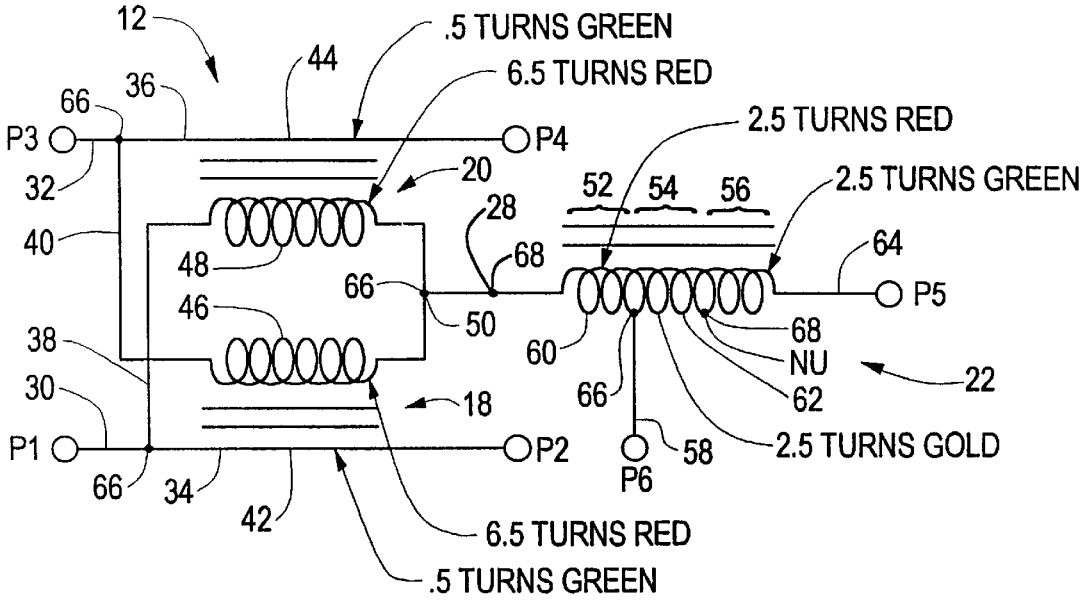
FIG. 4 is a schematic of the transformer of FIG. 1.

The ends of the greater windings are twisted together at twist junction 50 and connected at electrically conductive junction 28 for connection to autotransformer 22 (FIG. 4). The ends of the lesser windings 42, 44 run to terminals P2 and P4, respectively.

Figure 2B:
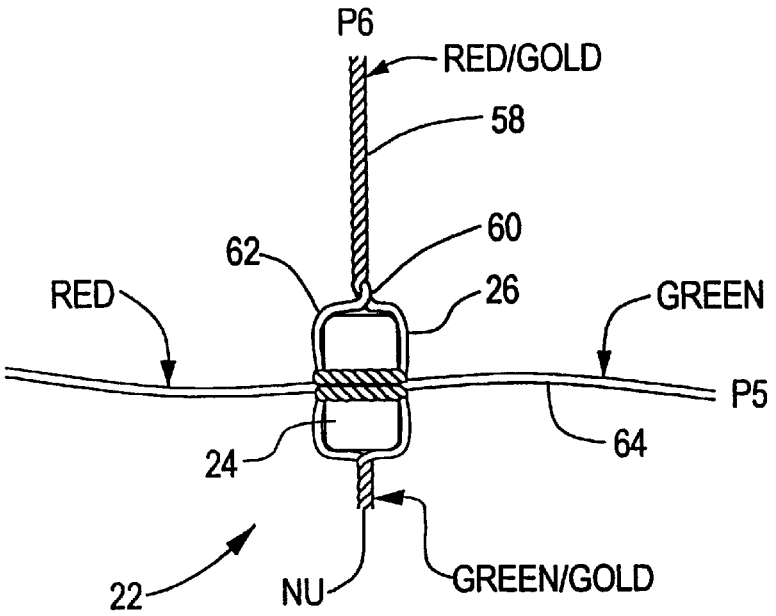
FIG. 2*b* is a side view of an autotransformer portion of the transformer in FIG. 1.

Referring to FIG. 2*b* and 4, the autotransformer construction is shown. Autotransformer winding 26 is wrapped around autotransformer core 24 and includes autotransformer winding segments 52, 54, 56. Autotransformer twisted pair 58 having red and gold strands 60, 62 respectively, is received by autotransformer core 24 from terminal P6. Red strand 60 and gold strand 62 are then wrapped around autotransformer core 24. Red strand 60 comprises a first autotransformer winding segment 52. Gold strand 62 comprises a second autotransformer winding segment 54. Autotransformer green strand 64 is wound around autotransformer core 24 to comprise a third autotransformer winding segment 56. The ends of autotransformer green strand 64 and gold strand 62 are both tinned to provide electrical conductivity, and are twisted together at junction NU in tight proximity to autotransformer core 24 such that green strand 64 and gold strand 62 remain taught. The number of turns used for each winding segment 52, 54, 56 may vary, but in the preferred embodiment is two and a half. Autotransformer green strand 64 then runs to terminal P5.

Autotransformer 22 is then attached to coupler 12 by tinning and joining autotransformer red strand 60 at electrically conductive junction 28. Although the preferred embodiment uses tinning and twisting to electrically couple strands, any suitable electrically conductive attachment method could be used.

Figure 3A:
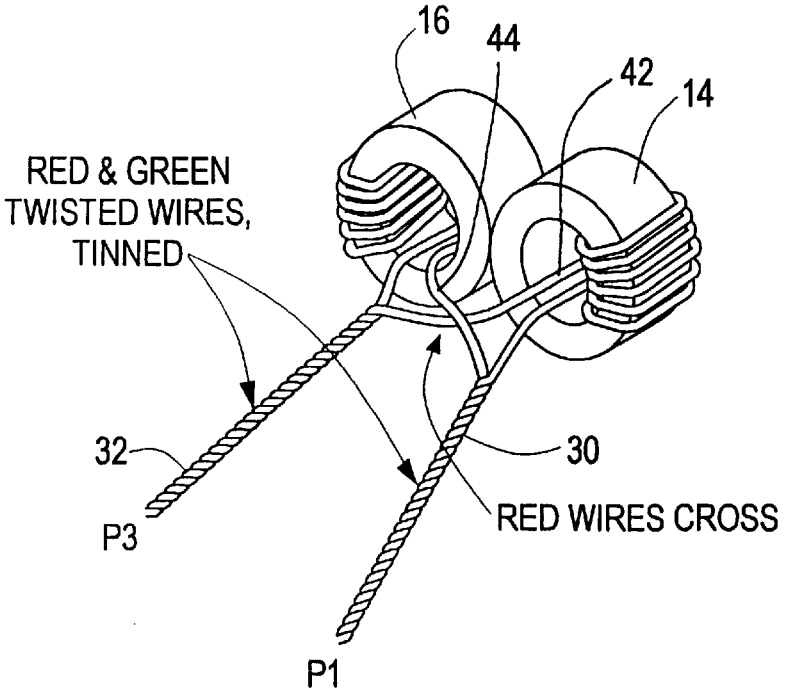
FIG. 3*a* is a perspective view of the coupler portion of FIG. 2*a;*
Figure 3B:
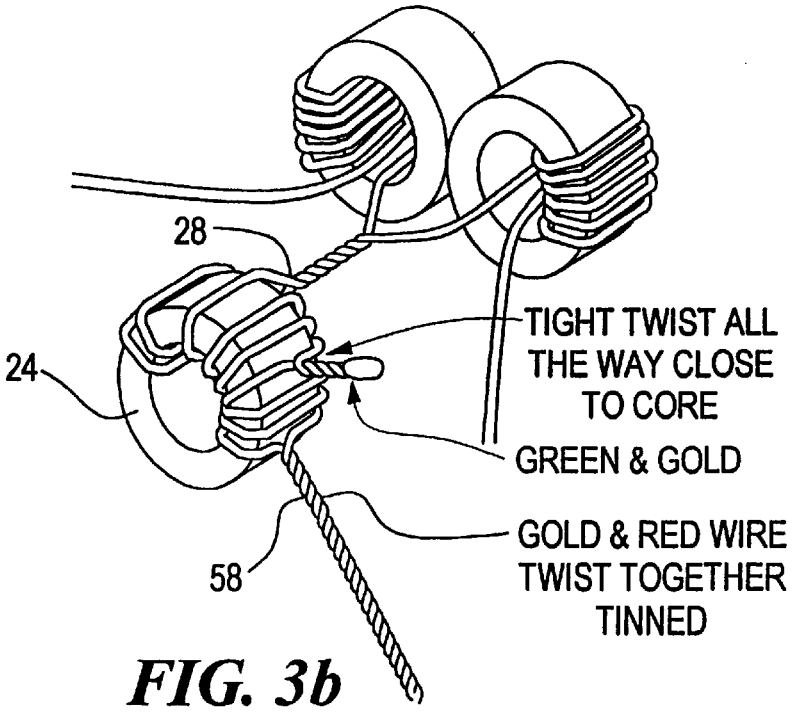
FIG. 3*b* is a perspective view of the transformer of FIG. 1.

Referring to FIGS. 3*a* and 3*b*, a perspective view of the coupler 12 and autotransformer 22 are shown. Note that first and second twisted pair strands 30, 32 remain twisted until in close proximity to coupler cores 14, 16. Note further that the lesser windings 42, 44 involve a single half turn through the core. Referring to FIG. 3*b*, autotransformer twisted pair 58 includes autotransformer red and gold strands 60, 62 comprising first and second winding segments 52, 54 and also remains twisted until in close proximity to autotransformer core 24. The first winding segment 52 includes autotransformer red strand 60, which is then connected to coupler 12 through electrically conductive junction 28. The second winding segment 54 is connected to the third winding segment 56 by twisting together the tinned ends of autotransformer gold and green strands 62, 64 respectively to form an unused terminal NU. The autotransformer green strand 64 then comprises the third winding segment 56 and runs to terminal P5.

Referring to the schematic (FIG. 4), the electrical interconnections are shown. Note that a solid line running from a terminal is either a single conductive strand or a twisted pair. Twisted pairs are subdivided into their respective strands at twist nodes 66. These nodes denote not electrically conductive unions, but rather the untwisting point and hence the point at which complementary flux effects of the twisted pair cease. These nodes are denoted by three members extending therefrom. In contrast, electrically conductive unions are denoted by nodes 68, having only two members extending therefrom. These nodes denote unions of electrical conductivity. The electrical connections between the greater and lesser windings 46, 48, 42, 44 is shown with respect to first and second twisted pair strands 30, 32. Also, the connections between the autotransformer winding segments 52, 54, 56 are shown with respect to intermediary autotransformer twisted pair 58 from terminal P6 and the connection to the third winding segment 56 terminating at P5. Finally, the twist junction 50 and the electrically conductive junction 28 between coupler 12 and autotransformer 22 is shown.

As various extension and modifications to the above description will be apparent to those skilled in the construction and physics of such RF transformers, the invention disclosed herein is not intended to be limited to the above but rather only by the spirit and scope of the following claims.

I claim:

1. A triple core toroidal transformer assembly comprising:

a first coupler core having a first coupler winding;

a second coupler core having a second coupler winding in flux communication with said first coupler;

a third core having a third winding, said third winding comprising a first winding strand segment and a second winding strand segment, said first and second winding strand segments extending from a twisted pair proximate to said third core and wherein said first winding strand segment is connected to said first and second coupler windings;

said third winding further comprises a third winding strand segment around said third core and connected to said second winding strand segment.

2. A triple core toroidal transformer assembly comprising:

a first coupler core having a first core greater winding and a first core lesser winding;

a second coupler core having a second core greater winding and a second core lesser winding, a first twisted conductor comprising a first plurality of strands;

a second twisted conductor comprising a second plurality of strands;

a third core having a winding, said winding comprised of interconnected winding segments; and wherein at least one of said interconnected winding segments is electrically connected to said first core greater winding and said second core greater winding.

3. The transformer of claim 2 wherein at least one of said first plurality of strands further comprises said first core greater winding and at least another of said first plurality of strands further comprises said second core lesser winding, and at least one of said second plurality of strands further comprises said second core greater winding and at least another of said second plurality of strands further comprises said first core lesser winding.

4. The transformer of claim 2 wherein said interconnected winding segments further comprise:

first and second interconnected winding strand segments extending from a third core twisted pair, wherein said first interconnected winding segment is electrically connected to said first core greater winding and said second core greater winding; and a third interconnected winding strand segment electrically connected to said second winding strand segment.

5. The transformer of claim 4 wherein said third interconnected winding strand segment is electrically connected to said second winding strand segment through twisting conductive surfaces of said winding strands in close proximity to said third core.

6. The transformer of claim 4 wherein said first, second, and third interconnected winding strand segments each comprise two and one half turns.

7. The transformer of claim 2 wherein said first plurality of strands comprises a twisted pair and said second plurality of strands comprises a twisted pair.

8. The transformer of claim 2 wherein said first core lesser winding and said second core lesser winding comprise one half turn; and said first core greater winding and said second core greater winding comprise 6 and one half turns.

9. The transformer of claim 2 wherein said first coupler core, said second coupler core, and said third core are in flux communication.

10. The transformer of claim 2 wherein said first coupler core, said second coupler core, and said third cores comprise ferrite cores.

* * * * *